United States Patent [19]

Silver

[11] Patent Number: 4,764,228

[45] Date of Patent: Aug. 16, 1988

[54] METHOD FOR PREPARING HYDRIDE CONFIGURATIONS AND REACTIVE METAL SURFACES

[75] Inventor: Gary L. Silver, Centerville, Ohio

[73] Assignee: The United States of America as represented by the United States Department of Energy, Washington, D.C.

[21] Appl. No.: 935,981

[22] Filed: Nov. 28, 1986

[51] Int. Cl.[4] ..... C23C 22/00; A61N 5/12; G21C 19/34

[52] U.S. Cl. ..... 148/6.14 R; 75/84.1 R; 420/2; 420/3; 423/4; 427/5

[58] Field of Search ..... 75/84.1 R, 84.1 A; 148/6.14 R; 420/1, 2, 3; 423/4; 427/5, 6, 287

[56] References Cited

U.S. PATENT DOCUMENTS 2,848,351 8/1958 Buller et al. ..... 427/5

4,296,074 10/1981 Yosim ..... 75/84.1 X

*Primary Examiner*—Michael R. Lusignan

*Attorney, Agent, or Firm*—Armand McMillan; James H. Chafin; Judson R. Hightower

[57] ABSTRACT

A method for preparing highly hydrogen-reactive surfaces on metals which normally require substantial heating, high pressures, or an extended induction period, which involves pretreatment of said surfaces with either a non-oxidizing acid or hydrogen gas to form a hydrogen-bearing coating on said surfaces, and subsequently heating said coated metal in the absence of moisture and oxygen for a period sufficient to decompose said coating and cooling said metal to room temperature. Surfaces so treated will react almost instantaneously with hydrogen gas at room temperature and low pressure. The method is particularly applicable to uranium, thorium, and lanthanide metals.

15 Claims, 2 Drawing Sheets

METHOD FOR PREPARING HYDRIDE CONFIGURATIONS AND REACTIVE METAL SURFACES

The U.S. Government has rights in this invention pursuant to Contract No. DE-AC04-76DP00053 between the U.S. Department of Energy and Monsanto Research Corporation.

BACKGROUND AND FIELD OF THE INVENTION

The present invention is directed to a method for preparing reactive metal surfaces, particularly uranium surfaces, whereby the metal is immediately reactive to hydrogen gas at room temperature and low pressure.

Processes for preparing metal compounds usually require specific heat and pressure conditions. It is, however, sometimes desirable to prepare metal compounds without these conditions. This situation might arise in the pyrotechnics industry where it is desired to pack the body of a flare with as much metal hydride as possible. Preparation of the metal hydride powder may be a time-consuming process requiring weighing and packing of the metal powder into the flare. The packing procedure requiring the use of a piston may also be undesirable because the pressure of the piston may deform or split the body of the flare. Moreover, many metal hydrides are pyrophoric and cannot be safely compressed because of the explosive danger presented by accidental sparks, and metal hydrides generally lose hydrogen upon heating so that heating during the process could present the possibility of a hydrogen explosion. Heating may also deform the carefully machined parts.

In addition, most metal hydrides are very reactive and cannot be handled in air or moisture without the risk of fire or the danger of ruining the hydride by oxygen contamination. Thus it is desirable for many reasons to be able to prepare metal hydrides and other metal compounds in situ without heat, undue pressure, excessive handling, or long waiting periods.

With relation to another field of industry, rapid advances in the electronics field often require the preparation of a compound on the surface of a metal in a very specific configuration, such as in a figure 8, an "X", or more complicated designs. Sometimes this is possible by procedures known in the art of alloy and semiconductor preparation. However, when the desired compound to be formed is a hydride, the known techniques have been found to be unsatisfactory.

The preparation of uranium hydride is one important process wherein previous procedures have been found to be unsatisfactory. Uranium metal, as most metals, naturally has an adherent oxide coating. The oxide layer is believed to slow the penetration of hydrogen molecules to the metal surface, thereby inhibiting the hydrogen-uranium reaction. This slow penetration of the hydrogen molecules creates an "induction period" or delay period of the reaction which is usually of an unpredictable length but may vary from a few minutes to several hours. Once initial penetration of the hydrogen molecules has taken place, the hydrogen-uranium reaction may then begin. However, the delay or the "induction period" is an undesirable characteristic.

OBJECTS AND SUMMARY OF THE INVENTION

It is therefore one object of the present invention to provide a process whereby metals are pretreated to create a reactive surface which will react instantaneously with pure hydrogen gas.

It is another object of the invention to provide a process for pretreating uranium metal to produce a reactive surface thereon which is instantaneously reactive with hydrogen gas.

It is a further object of the invention to overcome the problems associated with the "induction period" of previous reaction procedures.

It is still another object of the invention to provide a process whereby metals, including uranium, may be instantaneously reacted with hydrogen gas at room temperature and low pressures.

It is another object of the present invention to provide a prccess for preparing metal hydrides without the application of heat, undue pressure, excessive handling, or long waiting periods.

It is a still further object of the invention to provide a process whereby metal hydride surfaces can be prepared in specific configurations on the surface of a metal.

These and further objects of the present invention are accomplished by forming a hydrogen-bearing coating on a metal surface, and heating the coated metal in vacuum at a temperature sufficient to decompose the hydrogen-bearing coating. The resulting activated metal surface, when cooled to room temperature, will readily react with hydrogen gas at room temperature and low pressure. The hydrogen-bearing coating can be formed by treatment of the metal surface with a suitable acid, such as hydrochloric acid, or hydrobromic acid, or by subjecting the metal surface to the action of hydrogen gas, in the conventional manner. The process of the invention is particularly applicable to uranium metal. It is also applicable to many metals which conventionally require heating, undue pressure, excessive handling, or a long induction period in order to react with gaseous hydrogen to form a hydride.

DETAILED DESCRIPTION OF THE INVENTION

Figure 1:
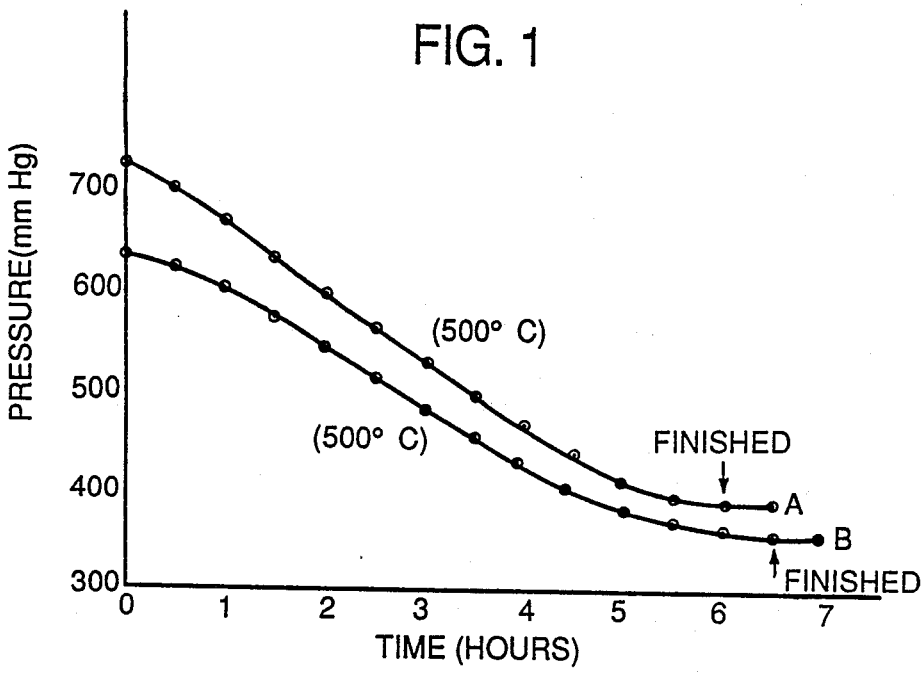
FIG. 1 is a graph showing the decrease in ambient hydrogen pressure during the hydriding of uranium pretreated by means of hydrochloric acid and subsequently heated at 500° C. in vacuum, according to the present invention.

The present invention is generally directed to a process for pretreating metal surfaces to activate them so that they become instantaneously reactive to hydrogen gas at room temperature and low pressures. This basic objective can be accomplished by either of two pretreatment procedures.

The first procedure comprises:

(a) removing the oxide scale from the metal surface with a suitable solvent; and (b) treating the metal surface with suitable acid.

The second procedure comprises:

(a) cleaning the metal with a suitable solvent to remove the oxide scale from the surface thereof; and (b) heating the cleaned metal in one atmosphere of hydrogen pressure at from 200° C. to 250° C. to partially hydride the surface thereof, and then removing the hydrogen gas.

A metal pretreated by either procedure can be stored and, later, be made immediately reactive to hydrogen gas by one rapid heat treatment at a temperature sufficient to decompose the hydrogen-bearing or hydride coating, in vacuum or in an inert gas. For example, a metal pretreated by either procedure can be heated to 100° C. or higher (depending on the coating involved) in a vacuum or in an inert gas for up to about ½ hour, cooled to room temperature, and then exposed to hydrogen gas at room temperature and low pressure, to undergo an instantaneous reaction.

The method of the present invention for preparing reactive surfaces by pretreating metal surfaces can be applied to a variety of metals, including uranium, thorium, niobium, and rare earth metals. It is, however, particularly adapted for the treatment of uranium to prepare uranium hydride. Thus, although the following discussion is primarily addressed to uranium, it should be understood that the concept of the invention is applicable to various other metals.

Whatever the procedure selected, the first step in the pretreatment procedure consists in the removal of oxide scale from the surface of the uranium metal. For this step, any suitable solvent can be used, as long as it sufficiently removes the oxide scale from the metal surface.

Removal of an oxide layer has previously been done, for instance, by a pickling technique utilizing 7M nitric acid. It has now been found, however, that removal of oxide scale is better done with a 1:1:1 mixture of water, concentrated nitric acid, and concentrated sulfuric acid. When this mixture is freshly prepared, it is too hot for immediate use, since it attacks uranium too vigorously. The mixture should be cooled to room temperature. It has been found that the cooled mixture gently removes the black oxide from the uranium surface and produces a surface which is less gray and more shiny than is usually achieved by treatment with plain nitric acid. Alternatively, the acid mixture can be warmed, which will slightly hasten the removal of the oxide layer, or a slightly more aqueous mixture can be utilized. Moreover, although cleaning with acid is preferred, other chemical or electrochemical techniques can also be used for the satisfactory removal of the oxide layer from the surface of uranium metal.

The second step in the first procedure of the invention comprises a pretreatment of the metal surface by subjecting it to an acid or to hydrogen gas. In the acid treatment, all or part of the metal is immersed in an appropriate acid, thereby resulting in the formation of an adherent hydrogen-bearing coating on the surface of the metal exposed to acid attack. For pretreatment of uranium, preferred acids are the hydrohalic acids such as HCl, HBr, and HI. The pretreatment of other metal surfaces may be conducted with other acids. For example, thorium can be pretreated with hydrohalic acids, rare earth metals can be treated with a variety of organic acids such as acetic acid, and niobium can be treated with hydrofluoric acid. In any case, oxidizing acids such as nitric acid must not be used.

In the preferred embodiment of the invention, uranium metal is pretreated by immersing in 9M hydrochloric acid, whereby an adherent hydrogen-bearing coating is formed on the metal. Treatment of the uranium metal with hydrochloric acid causes an acid attack on the surface of the metal, forming a hydrogen-bearing composition on the metal surface. The nature of this hydrogen-bearing composition is not fully understood but does not appear to be any form of uranium metal or uranium hydride.

Interestingly, A. G. Karabashch, who has treated both uranium and thorium with hydrochloric acid, has disclosed that the product obtained from such a reaction is a complex hydride, such as uranium or thorium hydroxyhydride (Zhurnal Neorganicheskoi Khimii, Vol. III, No. 4, 1958, pp. 986–995). In any event, since the metal coating composition formed by treatment with acid is decomposable by heat in vacuum or in an inert atmosphere to release hydrogen gas, it shall be referred to in this application either as a hydride or as a hydrogen-bearing composition. The hydrogen-bearing composition produced by the acid treatment yields a surface which is not reactive toward common contaminants such as water vapor, nitrogen gas and oxygen gas. In the past, prior procedures produced uranium which became contaminated, on storage, by exposure to humid air, oxygen, and nitrogen gas. However, treatment by the present process with an acid leaves an adherent hydrogen-bearing composition on uranium pieces, and they can be stored on the shelf in warm, humid air for moderate or limited periods, e.g., for about thirty minutes, without any deleterious effects on the metal.

Such "off the shelf" stored uranium can be made immediately susceptible to hydride formation by means of one rapid heat treatment, which causes the metal surface coating to lose hydrogen. This dehydriding leaves a reactive surface which will instantaneously react with hydrogen gas at room temperature. The heat treatment can be conducted in vacuum or in an inert gas atmosphere at 500° C. or higher and continued for up to about ½ hour.

It has also been found that the uranium metal can be pretreated and made immediately reactive to hydrogen gas by subjecting only a portion of the metal surface to acid treatment. Thus, if only the ends of the metal piece are immersed in the acid bath or otherwise exposed to acid attack, then the entire strip of metal will be hydrided at about the same rate as strips which have been entirely pretreated with the acid.

In addition, particular hydride configurations can be prepared on a metal surface by exposing the metal surface in the desired configuration to an appropriate acid treatment. Portions of metal not to be coated with hydrogen-bearing composition may be kept away from the acid treatment or may be immersed in the acid after application of a protective mask on the appropriate areas. On subsequent exposure to hydrogen gas, there will be produced metal hydrides in the desired configuration.

Following the acid treatment step, the metal is washed in water, then in acetone, and dried. After completion of this rinsing step, the metal is ultimately heated in vacuum or an inert gas atmosphere at about 500° C. or higher for a period of time which may vary from several minutes to about ½ hour, as described earlier. This outgassing at a high temperature produces a reactive surface on the metal, rendering it immediately reactable with hydrogen gas.

After the metal heating step has ended, the metal is cooled to room temperature. At that point and in that state, exposure of the metal surface to hydrogen gas at room temperature and under low pressure will result in an immediate hydride-forming reaction. The hydrogen gas is generally applied to the uranium metal at a pressure of about 15 psi, but it will be appreciated that other pressures can be used, so long as the pressure selected is sufficient to permit the hydride reaction to proceed smoothly to completion.

As discussed above, an important benefit of the present invention is that uranium metal pretreated with acid can be stored at room temperature in existing atmospheric conditions without undesirable effects and yet, the metal can be made immediately reactive to hydrogen gas at room temperature by merely heating it at 500° C. or higher in vacuum or in an inert gas atmosphere for a relatively short period of time. Thus, the pretreatment procedure of the present invention overcomes many of the problems previously associated with storage and handling of uranium metal and also provides for hydride-producing reactions which can be easily and safely conducted at room temperature and low pressures in a short period of time.

An alternative procedure for pretreating metal surfaces according to the present invention comprises:

(a) cleaning the oxide scale from the surface of the metal; and (b) heating the cleaned metal in one atmosphere of hydrogen at 200° C. to 250° C.

In this embodiment of the invention, the cleaning step for removing the oxide scale from the surface of the metal is identical to that employed in the acid treatment embodiment discussed above. Similar solvents and concentrations are utilized.

In the second embodiment, after the metal has been cleaned, the metal, e.g., uranium, is heated for about ½ hour or less in about one atmosphere or less of hydrogen at 200°–250° C. By this process, the metal is partially hydrided to a satisfactory extent; that is, a substantial coating of hydride is formed. The thus partially hydrided metal is then outgassed at 500° C. or higher for about ½ hour in vacuum or in an inert gas and the metal is cooled to room temperature.

Subsequent exposure of the thus pretreated metal with hydrogen gas at room temperature and low pressure results in an immediate hydride reaction.

In short, in this second embodiment of the invention, the important steps consist of prehydriding the metal at 200° C. to 250° C. and subsequently outgassing at 500° C. or higher. The specific extent of prehydriding does not appear to be critical. However, the more extensive the initial prehydriding, the faster will be the overall ultimate reaction of the uranium with hydrogen gas at room temperature.

Before proceeding with specific examples to further describe the invention in operative detail, it should be kept in mind that the pretreatment procedures of the invention are either not applicable nor desirably applied to the most reactive metals, e.g., those such as sodium which only yield a salt when reacted with, e.g., hydrochloric acid, or which naturally react with hydrogen gas without recourse to high pressures, high temperatures, or long induction periods. What those metals are can easily be determined from their known behavior in the presence of hydrogen gas or, in the case of acid pretreatment, by simple exposure to a non-oxidizing acid followed by observation of the results.

The pretreatment processes of the invention will now be described with specific examples which, although directed to specific parameters and metals, are intended as illustrations rather than limits of said invention.

EXAMPLE 1

Strips of uranium metal were prepared with dimensions of about 7.5 cm by 0.3 cm by about 0.25 mm and weights of about 1.8 g.

To illustrate conventional hydridation, one strip was cleaned in a 1:1:1 mixture of sulfuric acid, nitric acid and water. The clean strip was then heated at 500° C. for ½ hour and cooled to room temperature in a vacuum.

Upon admission of about 700 mm Hg pressure of hydrogen gas into the system, no reaction was apparent for about 10 hours. After this induction period, hydride formation began slowly, as evidenced by the decreasing hydrogen pressure. The reaction was complete after about an additional 50 hours.

EXAMPLE 2

Two more strips were cleaned in a 1:1:1 mixture of sulfuric acid, nitric acid and water. One was then completely immersed in a 9M HCl bath. The acid attack on the surface of the metal began immediately and the strip was removed after observing of the wine red color of $U^{3+}$. The thus pretreated metal strip was then washed with water and acetone, dried, and placed into a glass reaction flask. The flask was evacuated and heated to 500° C. Following this heat treatment, the strip was cooled to room temperature and subsequently exposed to hydrogen gas.

The reaction between the active uranium surface and the hydrogen gas commenced immediately and the reaction was brought to completion in about 6 to 7 hours, instead of the longer reaction time required in Example 1 without the acid pretreatment. (The completion time is taken as the time to first reach the apparent final stable pressure.) Thus, this method of pretreating the uranium metal completely eliminated the induction period observed in Example 1. The sequence of the process in this example is shown in FIG. 1, Curve A.

EXAMPLE 3

In this Example, the uranium strip was treated as in Example 2, except that only the ends of the strip were immersed in the HCl solution. Thus, only about 50% (about 3 cm) of the surface of the strip was precoated with a hydrogen-bearing composition. Nevertheless, as can be seen by the lower Curve B in FIG. 1, even this strip, which was pretreated at the ends only, exhibited immediate reaction with the hydrogen gas and that reaction proceeded to completion in a time period comparable to that observed in Example 2, where the entire strip was pretreated.

EXAMPLE 4

In this example, the uranium strips were not subjected to the cleaning step for removing the oxide from the surface of the metal. Rather, the strips were merely immersed in warm 9M HCl. The strips were then washed with water and acetone, dried in vacuum, and heated to 494° C. in vacuum. After heat treatment at 494° C. for 20 minutes, the metal strips were cooled in vacuum to room temperature.

Hydrogen gas was subsequently admitted to the vessel. The temperature was observed to rise from 24.7° C. to 30.6° C., and an immediate reaction with the hydrogen gas and the uranium metal surface was indicated by the rapidly decreasing hydrogen pressure. The initial hydrogen pressure observed was about 708.6 mm. After about 4.5 hours, the pressure dropped to 251.1 mm and, when the reaction was complete, the pressure was 78.1 mm.

EXAMPLE 5

Figure 2:
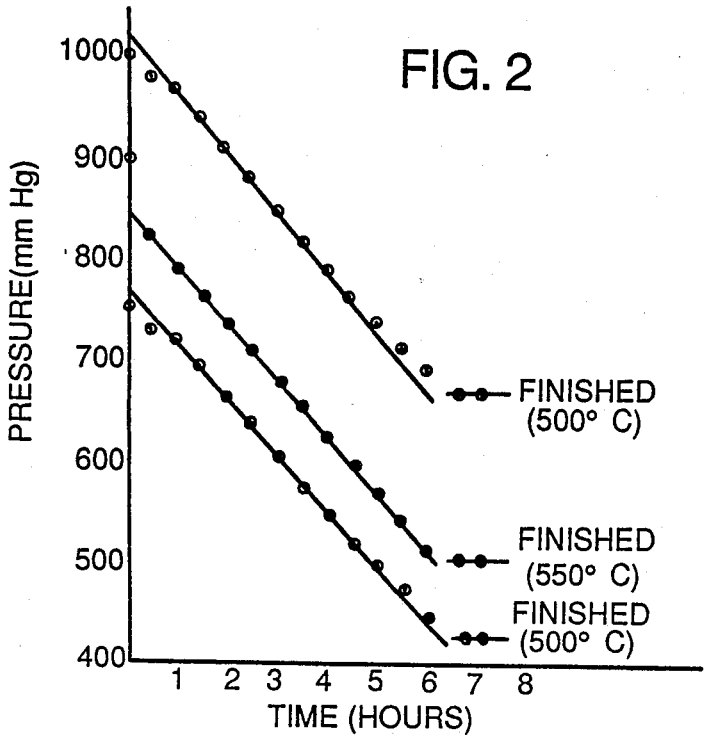
FIG. 2 is a graph showing the decrease in ambient hydrogen pressure during the hydriding of uranium pretreated with hydrogen gas, followed by heating at 550° C. or 500° C. in vacuum, according to the present invention.
Figure 3:
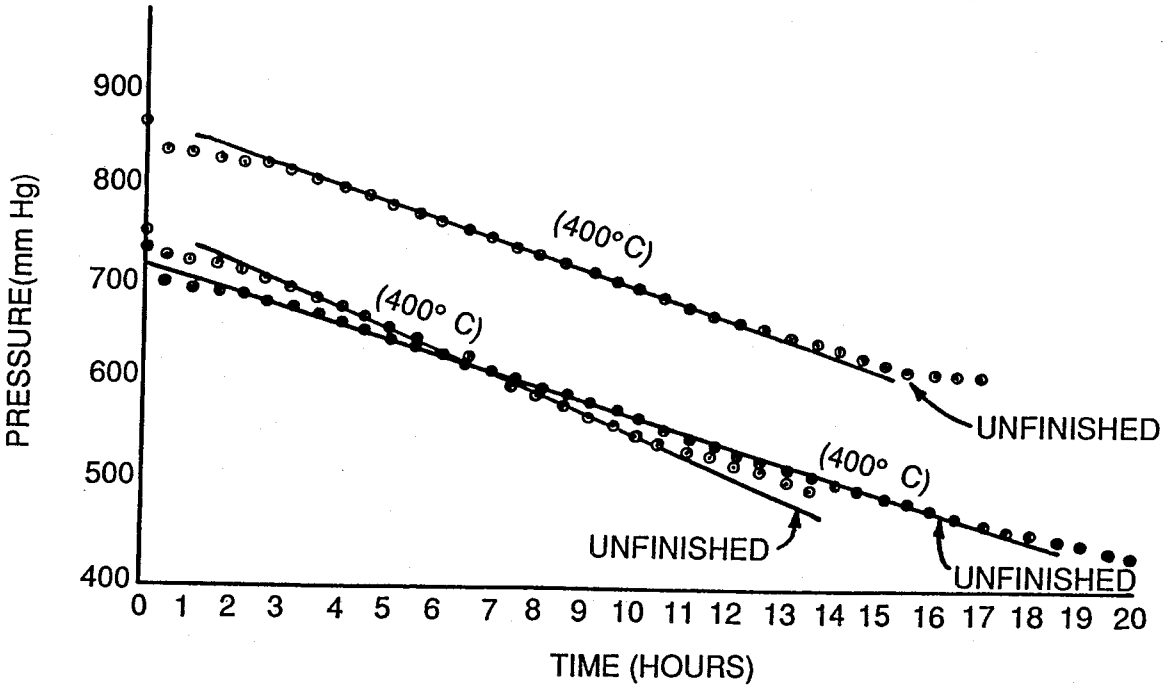
FIG. 3 is a graph showing the decrease in ambient hydrogen pressure during the hydriding of uranium pretreated with hydrogen gas, followed by dehydriding at 400° C. in vacuum, according to the present invention.

FIGS. 2 and 3 show the effect of dehydriding the surface hydride layer on the uranium strips at 500° C. or 550° C., and 400° C., respectively. It can be seen from a comparison of FIGS. 1, 2, and 3, that the higher the temperature of the dehydriding reaction, the faster the rate of reaction. In each case, however, the reaction between the metal and the hydrogen began immediately without the presence of an induction period. The reactive metal surfaces used in obtaining data for FIGS. 2 and 3 were prepared by hydriding strips of uranium with hydrogen gas at about 300° C., and then dehydriding at the indicated temperature for ½ hour. Each line in the figures represents a different experiment.

EXAMPLE 6

As in Example 1, two strips of uranium metal were cleaned with an appropriate solvent to remove the oxide layer. The cleaned strips were allowed to react with hydrogen gas at one atmosphere at 250° C., until a substantial coating of hydride had formed. Hydrogen was then removed from the system and strips were out gassed at 500° C. for ½ hour. Upon cooling to room temperature, both strips were exposed to hydrogen gas at room temperature and exhibited hydriding behavior (FIG. 2).

From the above examples, it can be seen that hydrogen, at low pressure, can be made to react rapidly with strips of uranium metal if the strips have been given proper pretreatment. The pretreatment can take the form of cleaning the oxide scale from the surface of the uranium strips with a suitable solvent, immersing all or part of the strip in an acid such as HCl, HBr or HI to form an adherent hydrogen-bearing coating, washing, drying and then heating in vacuum at 500° C. or higher for a period of time from several minutes to ½ hour. In this manner, the metal strips, particularly uranium, are prepared to react with hydrogen at room temperature and low pressure immediately after exposure to the hydrogen gas without an induction period.

Alternatively, the cleaned uranium strips can be prehydrided by heating for about ½ hour in one atmosphere of hydrogen at 200°–250° C. After the strips have been hydrided to a satisfactory extent, the hydrogen is removed from the vessel, the strips are heated to 500° C. or higher, and then cooled. Subsequent exposure of the strips to hydrogen gas at room temperature will result in an immediate hydriding reaction.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for preparing hydrogen-reactive surfaces on a metallic body, comprising:

(a) forming an adherent hydrogen-bearing coating on selected surfaces of said body;

(b) heating said body in a vacuum or in an inert atmosphere at a temperature sufficient to decompose said coating; and (c) cooling said metal body to room temperature under said conditions.

2. The method of claim 1, wherein the hydrogen-bearing coating is formed by immersing the metallic body surfaces in a non-oxidizing acid.

3. The method of claim 1, wherein the hydrogen-bearing coating is formed by subjecting the metallic body surfaces to one atmosphere of hydrogen gas at 200° to 250° C. to partially hydride said surfaces.

4. The method of claim 1, wherein said metal surface is first cleaned with a suitable solvent to remove an oxide scale from the surface thereof.

5. The method of claim 1, wherein said dehydriding step is carried out for a period ranging from several minutes to ½ hour.

6. The method of claim 1, wherein said metal is uranium.

7. The method of claim 1, wherein said metal is thorium.

8. The method of claim 2, wherein said acid is HCl, HBr, HI, or acetic acid.

9. The method of claim 2, wherein said acid is 9M HCl.

10. The method of claim 6, wherein the metal is uranium, the acid is HCl, HBr, or HI, and the heating step is carried out in a vacuum at 500° C. or higher for a period ranging from several minutes to about ½ hour.

11. The method of claim 10, wherein the acid is 12M HCl

12. The method of claim 2, wherein only selected portions of said metal surfaces are immersed in said acid.

13. The method of claim 2, wherein the portions of said metal surfaces not to be exposed to said acid are covered with a protective material.

14. The method of claim 13, wherein said protective material is applied in a pattern so that the hydrogen-bearing coating formed by said acid assumes a predetermined configuration.

15. The method of claim 2, where said metal is a lanthanide and said acid is acetic acid.

* * * * *